United States Patent [19]

Höfer et al.

[11] 4,164,921

[45] Aug. 21, 1979

[54] FUEL INJECTION PUMP

[75] Inventors: Gerald Höfer, Weissach-Flacht; Franz Eheim, Stuttgart, both of Fed. Rep. of Germany

[73] Assignee: Robert Bosch GmbH, Stuttgart, Fed. Rep. of Germany

[21] Appl. No.: 847,300

[22] Filed: Oct. 31, 1977

[30] Foreign Application Priority Data

Oct. 29, 1976 [DE] Fed. Rep. of Germany ..... 2649893

[51] Int. Cl.[2] ..... F02M 39/00; F02D 1/06

[52] U.S. Cl. ..... 123/139 AF; 123/140 FG; 123/139 ST

[58] Field of Search ..... 123/140 FG, 139 AD, 123/139 AF, 139 BD, 139 ST, 179 L; 417/289, 310, 499

[56] References Cited

U.S. PATENT DOCUMENTS

| | | | |
|---|---|---|---|
| 2,810,376 | 10/1957 | Aldinger | 123/139 ST |
| 2,833,218 | 5/1958 | Evans | 123/139 ST |
| 3,025,797 | 3/1962 | Hutcheon | 123/139 ST |
| 3,620,648 | 11/1971 | Hafer et al. | 123/139 BD |
| 3,631,743 | 1/1972 | Eckert et al. | 123/139 AF |
| 3,638,631 | 2/1972 | Eheim | 123/139 ST |
| 3,777,731 | 12/1973 | Kobayashi et al. | 123/139 BD |
| 3,827,832 | 8/1974 | Faupel et al. | 123/139 AD |

*Primary Examiner*—Charles J. Myhre
*Assistant Examiner*—P. S. Lall
*Attorney, Agent, or Firm*—Edwin E. Greigg

[57] ABSTRACT

A fuel injection pump with a constant end of fuel delivery that is provided by opening a discharge channel after a predetermined stroke, in which the discharge channel is blocked by an annular slide controlled by the fuel pump pressure.

7 Claims, 1 Drawing Figure

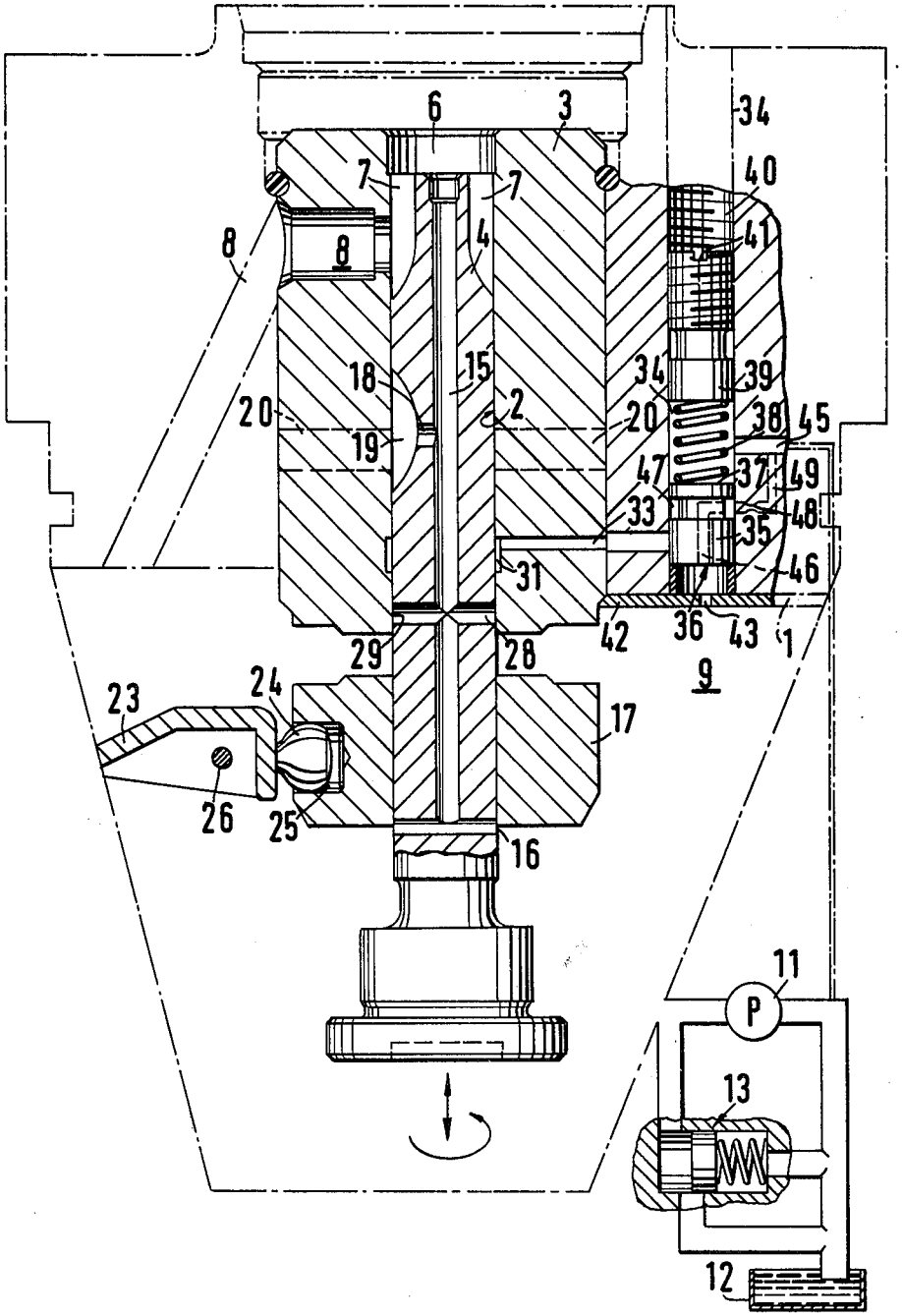
6
3
34
7
7
40
8
8
4
41
18
15
34
39
20
2
20
38
45
19
47
37
49
33
48
35
31
46
42
36
43
1
29
28
9
23
24
17
26
25
16
11
P
13
12

FUEL INJECTION PUMP

BACKGROUND OF THE INVENTION

The invention relates to fuel injection pumps for internal combustion engines having a housing, one pumping chamber and at least one reciprocating pump piston, arranged to open a discharge channel of the pumping chamber that is adapted to be blocked at starting rpm, and further with a pump which supplies fuel at an rpm-dependent pressure especially in the suction chamber of the injection pump. In a known fuel injection pump the blocking of the discharge channel at starting rpm occurs by means of an annular slide which is disposed around the pump piston and thus controls the injection quantity. In this manner there is a direct dependence of the shut-off of the starting quantity on the rpm and load-dependent adjusted position of the annular slide and of the fuel injection quantity associated with this position. For many internal combustion engines, however, it is desirable that an increased quantity of fuel continue to be injected during starting even after engine starting speeds are exceeded, certainly at least until the engine is running quite rapidly.

OBJECT AND SUMMARY OF THE INVENTION

Accordingly it is the primary object of this invention to provide an improved fuel injection pump wherein the reciprocating pump piston is arranged to open a discharge channel and the discharge channel is in communication with a control piston that is arranged to be actuated by the fuel pressure of the supply pump.

With the foregoing in mind, it is also to be understood that the invention also has the advantage that the increased starting quantity proceeds independently of the position of an injection regulating member, so that a cut-off of the increased starting quantity can occur that is largely independent of the quantity control.

Another object of the present invention is to position the control piston in a bore in the pump housing adjacent to the pump piston with intercommunication being provided between the discharge channel controlled by the pump piston and those flow channels that are under the control of the spring-loaded control piston.

Still another advantage of this invention is the possibility of a delayed opening of the discharge channel above the starting rpm.

The invention will be better understood as well as further objects and advantages thereof become more apparent from the ensuing detailed description when considered in conjunction with the drawing.

BRIEF DESCRIPTION OF THE DRAWING

The single FIGURE is a longitudinal generally schematic sectional view of a fuel injection pump with the piston and its cooperative cylinder revealed in cross section.

DESCRIPTION OF THE PREFERRED EMBODIMENT

Turning now to the drawing, a pump piston 4 is arranged to be reciprocated and simultaneously rotated by means (not shown) within a bore 2 of a cylinder sleeve 3 which is mounted in the pump housing 1 of a fuel injection pump that is only schematically shown in dotted lines. The pumping chamber 6 of this pump is supplied with fuel which is taken from a suction chamber 9, via longitudinal grooves 7 located in the skirt surface of the pump piston and via at least one bore 8 which traverses the cylinder sleeve 3 in the housing 1, so long as the pump piston 4 executes its suction stroke, or until the pump piston assumes its bottom dead center position. The suction chamber 9 is supplied with fuel from a fuel container 12 by means of a fuel feed pump 11. In a known manner, the pressure in the suction chamber 9 is rpm-dependently controlled by means of a pressure control valve 13, so that the pressure in the suction chamber 9 rises with an increase of the rpm.

A relief duct 15 provided in the pump piston extends to a discharge opening 16 from the pumping chamber 6 and opens into the pump suction chamber 9 in the lower pump piston part that protrudes from the pump cylinder 3. The discharge opening 16 is controlled by means of an annular slide 17 which cooperates with the pump piston. A transverse bore 18 which opens into a longitudinal distributing groove 19 in the skirt surface of the pump piston further branches off the relief duct 15 within that part of the pump piston 4 that extends into the cylinder sleeve 3. One of the pressure lines 20, shown in dotted lines, is connected with the pumping chamber 6 during each given feed stroke of the pump piston via the relief duct 15, the transverse bore 18, and the longitudinal distributing groove 19 after the piston, by rotating, has closed the bore 8. The pressure lines 20 each lead via a pressure valve (not shown) to the individual fuel injection jets of the cylinders of an internal combustion engine (not shown) and are distributed around the periphery of the bore 2 in accordance with the number of cylinders of the engine that are to be supplied. Fuel is thereby delivered to the fuel injection jets via the relief duct 15 during the feed stroke of the pump piston 4 as long as the discharge opening 16 of the relief duct 15 remains closed by means of the annular slide 17.

The annular slide 17 is displaced by an rpm governor (not shown) in dependence on load and rpm toward the pump piston 4 with the aid of an intermediate lever 23, which engages with a head 24 provided in a recess 25 in the annular slide 17 and is pivotable around an axis 26. In this manner, a shifting of the annular slide 17 downward causes the discharge opening 16 of the longitudinal duct 15 to be blocked earlier during the supply stroke of the pump piston 4, so that the fuel supply to the engine begins earlier. The farther the annular slide 17 is displaced downwardly, the greater is the fuel quantity delivered to the engine. On the other hand, the injected quantity of fuel decreases the higher the annular slide 17 is pushed upwardly, since the actual injection begins at a substantially later point in time in the supply stroke of the pump piston 4. The upper ranges of the annular slide 17 correspond to the idling and partial load, while the lower ranges correspond to the full load and the starting rpm.

In addition, an overflow channel 28 which branches off from the discharge channel 15 is arranged in the pump piston 4, with two apertures 29 that terminate at the perimeter of the piston. These apertures 29 are arranged in the area of the cylinder bushing 3 and are opened toward the end of the stroke of the pump piston 4 by an annular groove 31 located in the bore 2 of the cylinder bushing 3. This annular groove 31 is connected through a channel 33 with a bore 34, which is provided in the housing 1 and communicates with the suction chamber 9. An axially movable control piston 35 is disposed in the bore 34, this piston being arranged to be acted upon on one front side 36 by fuel from the suction chamber 9 and is loaded on the other side 37 thereof by a spring 38. The force of the spring 38 can be varied by an adjusting piston 39 which has a threaded section, that is screwed into a threaded section 40 of the bore 34. The adjusting piston 39 is provided with a kerf 41 on the side opposite the spring 38 and through which the adjusting piston 39 can be rotated from outside the pump.

The bore 34 is separated from the suction chamber 9 by a perforated plate 42, this perforation providing a throttle opening 43 in the area of the bore and through which throttle opening 43 the fuel can flow from the suction chamber 9 into the bore 34 and vice versa.

During the starting of the engine, the perimetral wall of the piston 35 closes the opening of the channel 33 in the bore 34 so that at the end of the stroke of the pump piston 4 no fuel can flow out of the pumping chamber 6 into the suction chamber 9. As soon, however, as a pressure which corresponds to the idling of the engine prevails in the suction chamber 9, the control piston 35 is pushed against the force of the spring 38 thereby opening the channel 33. From this rpm on, the openings 29 of the overflow channel 28 are connected by means of the annular groove 31 and the channel 33 with the suction chamber 9, so that after apertures 29 have been opened the injection is ended. Thus less fuel is supplied to the engine than at starting rpm. The difference in the fuel supply is the so-called starting quantity. By means of the throttle opening 43 the motion of the control piston 35 is delayed in its upward movement, depending on the rpm attained at any given moment, so that the starting quantity is not cut off until the rpm is above the idling rpm. This has the distinct advantage in that a stable idling condition is attained sooner. This hysteresis, however, can also by achieved by a throttled outflow of a part of the fuel which acts on the control piston 35 during starting rpm, as shown by the broken line. The piston 35 includes a longitudinal bore 46 that extends from the lower surface 36 thereof up to an annular groove 47 that is provided in said piston, as shown. This groove communicates with an aperture provided in the housing 1 that leads to a throttle 48 which in turn is arranged to lead to a conduit 49 that empties into a discharge channel 45 that communicates with the area that contains the spring 38. Thus the moment when the control piston 35 opens the channel 33 at an rpm higher than the starting rpm is the latest time that the annular groove 47 is separated from the channel 49, so that there can be no further flow through the channel 49. It is to be understood that the outflow causes the delayed movement of the piston 35.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a housing, a supply pump that delivers fuel under rpm-dependent pressure into a suction chamber of said injection pump, a pumping chamber in communication with said suction chamber, at least one reciprocating pump piston and an associated discharge channel, said pump piston arranged to open said discharge channel of said pumping chamber that is adapted to be blocked at starting rpm, the improvement in which said discharge channel extends to a bore, a control piston in said bore arranged to be actuated by the fuel pressure of said supply pump and said control piston having an oppositely disposed face which is acted upon by a spring means.

2. A fuel injection pump according to claim 1, in which a throttle means is arranged between the suction chamber and the control piston.

3. A fuel injection pump according to claim 2, in which said discharge channel opens into the control piston bore and above the starting rpm its opening lies in the section of the bore which is connected with the supply pump.

4. A fuel injection pump according to claim 1, in which a throttle means is arranged between the suction chamber and said other surface of said control piston.

5. A fuel injection pump according to claim 1, in which one face of said control piston communicates with a low pressure chamber in said housing through a channel that extends from a passageway in said control piston into said housing and through a throttle means, said channel in said housing being blocked during the stroke movement of the control piston.

6. A fuel injection pump according to claim 1, wherein said discharge channel is defined in part by an internal duct in said pump piston, and has a secondary opening leading to said suction chamber for determining the onset of fuel injection, said secondary opening being obturatable by a control slide which is actuated by a speed governor.

7. A fuel injection pump according to claim 1, in which the pretension of said spring can be varied from outside the pump.

* * * * *